US009127557B2

(12) United States Patent
Davis, III et al.

(10) Patent No.: US 9,127,557 B2
(45) Date of Patent: Sep. 8, 2015

(54) NOZZLE MOUNTING AND SEALING ASSEMBLY FOR A GAS TURBINE SYSTEM AND METHOD OF MOUNTING AND SEALING

(75) Inventors: Charles Lewis Davis, III, Simpsonville, SC (US); Ibrahim Sezer, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 646 days.

(21) Appl. No.: 13/492,180

(22) Filed: Jun. 8, 2012

(65) Prior Publication Data

US 2013/0327854 A1 Dec. 12, 2013

(51) Int. Cl.

| | |
|---|---|
| ***F01D 9/04*** | (2006.01) |
| ***F01D 11/00*** | (2006.01) |
| ***F01D 25/24*** | (2006.01) |

(52) U.S. Cl.

CPC ..... *F01D 9/041* (2013.01); *F01D 9/042* (2013.01); *F01D 11/005* (2013.01); *F01D 25/246* (2013.01); *F05D 2240/55* (2013.01); *F05D 2240/80* (2013.01); *F05D 2260/30* (2013.01); *Y10T 29/494* (2015.01)

(58) Field of Classification Search

CPC ..... F01D 9/04; F01D 9/041; F01D 9/042
See application file for complete search history.

(56) References Cited

U.S. PATENT DOCUMENTS

| | | | | |
|---|---|---|---|---|
| 4,815,933 | A | 3/1989 | Hansel et al. | |
| 4,883,405 | A | 11/1989 | Walker | |
| 5,176,496 | A | 1/1993 | Correia et al. | |
| 5,957,657 | A * | 9/1999 | Akita et al. | 415/115 |
| 6,164,903 | A * | 12/2000 | Kouris | 415/135 |
| 8,038,389 | B2 | 10/2011 | Arness et al. | |
| 8,171,690 | B2 * | 5/2012 | Ghatikar et al. | 52/506.05 |
| 2007/0154305 | A1 * | 7/2007 | Arness et al. | 415/209.2 |
| 2009/0169361 | A1 * | 7/2009 | Cole et al. | 415/115 |

* cited by examiner

*Primary Examiner* — Edward Look
*Assistant Examiner* — Cameron Corday

(57) ABSTRACT

A nozzle assembly includes a nozzle having a trailing edge of an outer band and an anti-rotation pin slot. Also included is a retaining ring extending circumferentially about the outer surface of the outer band, wherein the retaining ring includes an anti-rotation pin and an anti-rotation pin hole, wherein the anti-rotation pin is configured to fittingly reside in an axial orientation within the anti-rotation pin slot and the anti-rotation pin hole. Further included is a seal plate seated on the outer surface of the outer band and configured to retain the anti-rotation pin. Yet further included is a washer disposed within a bored portion of the seal plate, wherein the bored portion is aligned with an aperture within the retaining ring, wherein a mechanical fastener extends into the retaining ring through the bored portion to operably couple the seal plate to the retaining ring.

14 Claims, 3 Drawing Sheets

NOZZLE MOUNTING AND SEALING ASSEMBLY FOR A GAS TURBINE SYSTEM AND METHOD OF MOUNTING AND SEALING

BACKGROUND OF THE INVENTION

The subject matter disclosed herein relates to gas turbine systems, and more particularly to a nozzle mounting and sealing assembly, as well as methods for mounting and sealing such nozzle assemblies.

Nozzle assemblies typically include a plurality of circumferentially spaced vanes extending between a radially inner portion and a radially outer portion of the gas turbine system. Fuel-air mixtures ignited in a combustor section of the gas turbine system are channeled towards a turbine section through the plurality of circumferentially spaced vanes. In order to maintain effective and efficient overall system performance, adequate mounting and sealing of the nozzle assemblies at the radially inner portion and the radially outer portion is required. Various mounting and sealing structures have been employed in attempts to meet such requirements, however, stresses imposed on the nozzle assemblies during operation of the gas turbine system often result in conditions causing multiple structural issues, such as component cracking and inefficient sealing, for example.

BRIEF DESCRIPTION OF THE INVENTION

According to one aspect of the invention, a nozzle mounting and sealing assembly for a gas turbine system includes a nozzle having a trailing edge of an outer band and an anti-rotation pin slot. Also included is a retaining ring extending circumferentially about the outer surface of the outer band, wherein the retaining ring includes an anti-rotation pin and an anti-rotation pin hole, wherein the anti-rotation pin is configured to fittingly reside in an axial orientation within the anti-rotation pin slot and the anti-rotation pin hole. Further included is a seal plate seated within the notch of the outer band and configured to retain the anti-rotation pin within the anti-rotation pin slot. Yet further included is a washer disposed within a bored portion of the seal plate, wherein the bored portion is aligned with an aperture within the retaining ring, wherein a mechanical fastener extends into the retaining ring through the bored portion to operably couple the seal plate to the retaining ring.

According to another aspect of the invention, a nozzle mounting and sealing assembly for a gas turbine system includes a nozzle having an outer band integrally formed with a radially outer portion of at least one vane, wherein the outer band includes a leading edge and a trailing edge. Also included is a retaining ring engaged with and extending circumferentially about the outer surface of the outer band, wherein the retaining ring includes an anti-rotation pin and an anti-rotation pin hole, wherein the anti-rotation pin is configured to fittingly reside within an anti-rotation pin slot and the anti-rotation pin hole. Further included is a seal plate having a forward side, an aft side, a radially inner edge and a radially outer edge, wherein the radially inner edge is disposed along the outer surface of the outer band, thereby retaining the anti-rotation pin within the anti-rotation pin slot. Yet further included is a stepped aperture disposed within the seal plate proximate the radially outer edge, wherein the stepped aperture includes a first bore proximate the aft side and a second bore proximate the forward side, wherein the first bore comprises a larger diameter than the second bore, wherein a cup washer is disposed within the stepped aperture for receiving a mechanical fastener, wherein the mechanical fastener extends into the retaining ring for fastening the seal plate to the retaining ring.

According to yet another aspect of the invention, a method of mounting and sealing a nozzle assembly within a gas turbine system is provided. The method includes disposing a retaining ring proximate at least one nozzle by axially orienting an anti-rotation pin of the retaining ring within an anti-rotation pin slot of the at least one nozzle. Also included is positioning a seal plate along an outer surface of the at least one nozzle proximate a trailing edge of the at least one nozzle. Further included is mounting the seal plate to the retaining ring with a mechanical fastener extending into a cup washer disposed within a bored portion of the seal plate and into an aperture disposed within the retaining ring.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
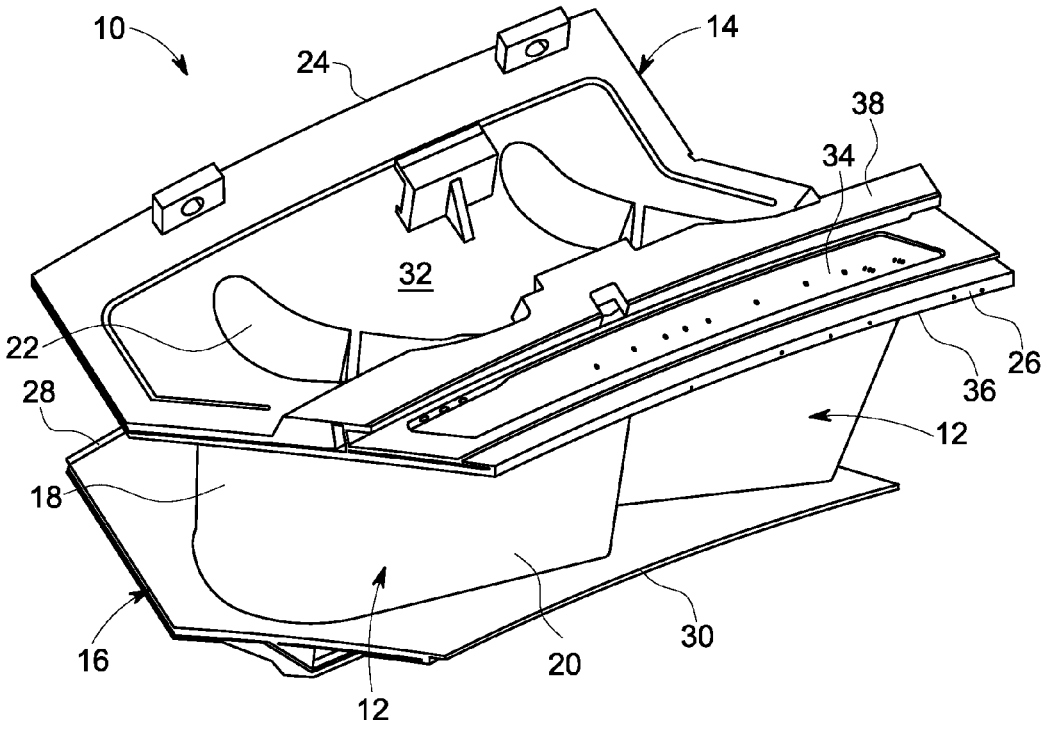
FIG. 1 is a top perspective view of a nozzle.
Figure 2:
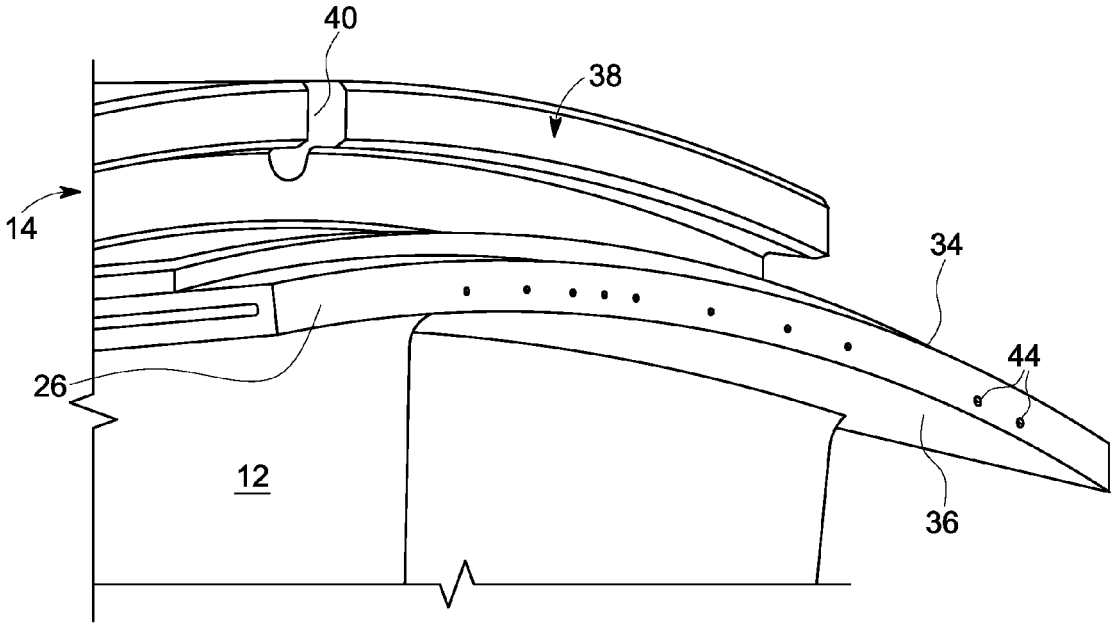
FIG. 2 is an enlarged perspective view of a trailing edge of the nozzle of FIG. 1.

Referring to FIGS. 1 and 2, a nozzle assembly is generally illustrated with numeral 10. The nozzle assembly 10 comprises at least one vane 12, but typically a plurality of vanes are disposed circumferentially about a center axis of a gas turbine system (not illustrated). The at least one vane 12 is a fully or partially hollow airfoil that extends between an outer band 14 and an inner band 16 that are each arcuately shaped. The at least one vane 12 may be integrally formed with the outer band 14 and the inner band 16 to form a single structure, specifically the nozzle assembly 10. The at least one vane 12 includes a pressure sidewall 18 and a suction sidewall 20 that define a cooling cavity 22.

The outer band 14 includes an outer band leading edge 24 and an outer band trailing edge 26. Similarly, the inner band 16 includes an inner band leading edge 28 and an inner band trailing edge 30. The outer band 14 further includes a platform 32 extending between the outer band leading edge 24 and the outer band trailing edge 26, with the platform 32 having an outer surface 34 and an inner surface 36. An aft flange 38 is disposed proximate the outer band trailing edge 26 and extends generally radially outwardly therefrom. More specifically, the aft flange 38 extends radially outwardly from the outer surface 34 of the outer band 14. Formed within the aft flange 38 is an anti-rotation pin slot 40, the function of which will be described in detail below.

Figure 3:
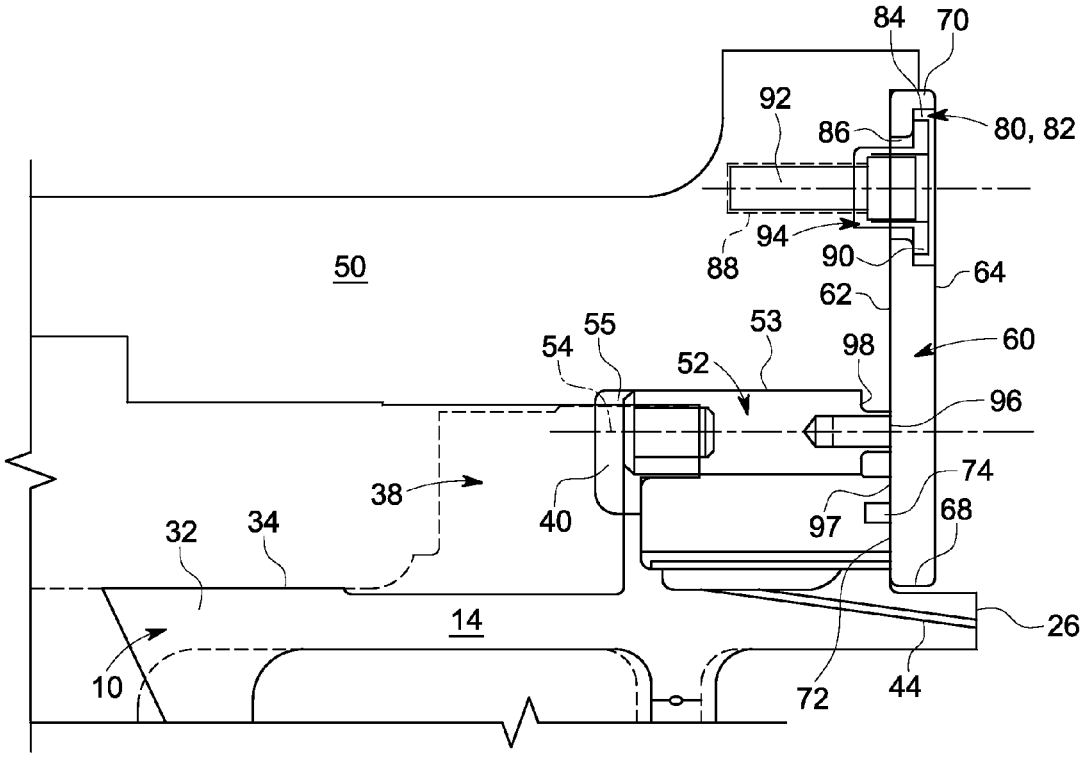
FIG. 3 is a cross-sectional view of a nozzle mounting and sealing assembly.

Referring now to FIG. 3, in addition to FIG. 2, at least one cooling hole 44 extends through the outer band 14 proximate the outer band trailing edge 26. As illustrated, the at least one cooling hole 44 typically comprises a plurality of cooling holes circumferentially spaced from each other and extending in a relatively parallel orientation. The at least one cooling hole 44 may be oriented at numerous angles, such as that shown in the illustrated example. Irrespective of the precise angle, the at least one cooling hole 44 extends in close proximity to, but radially inwardly of, the outer surface 34 of the outer band 14. The at least one cooling hole 44 provides a cooling effect on the outer band trailing edge 26 during operation of the gas turbine system. Gas turbine system operation entails channeling a hot air-fuel mixture through a path defined by the outer band 14 and the inner band 16. The hot air-fuel mixture passes over the at least one vane 12 and is passed downstream. During passage of the hot air-fuel mixture over the at least one vane 12 and along the inner surface 36 of the outer band 14, thermal stresses are imposed on the outer band 14. A cooling source (not illustrated) provides regions proximate the outer surface 34 with a cooling flow for countering the effects of the hot air-fuel mixture. The outer band trailing edge 26 is cooled, in part, by passing the cooling flow through the at least one cooling hole 44. The at least one cooling hole 44 also reduces ingestion leakage effects of the hot air-fuel mixture into regions proximate the outer surface 34 of the outer band 14, as well as the outer band trailing edge 26.

A retaining ring 50 is disposed radially outwardly of the outer band 14 of the nozzle assembly 10 and in close proximity to the aft flange 38. The retaining ring 50 extends circumferentially about at least a portion of the outer surface 34 of the outer band 14 and includes an anti-rotation pin 52 and an anti-rotation pin hole 53, with the anti-rotation pin 52 configured to be positioned within the anti-rotation pin slot 40 disposed within the aft flange 38 of the nozzle assembly 10. The anti-rotation pin 52 is configured to be axially aligned, with respect to a longitudinal axis of the gas turbine system, when disposed within the anti-rotation pin slot 40 of the aft flange 38. The anti-rotation pin 52 provides proper circumferential positioning of the nozzle assembly 10, with respect to the retaining ring 50, during assembly. The anti-rotation pin 52, upon installation into the anti-rotation pin slot 40, engages and operably couples the retaining ring 50 with the nozzle assembly 10, and more specifically the outer band 14. The anti-rotation pin 52 fits within the anti-rotation pin slot 40 with an axial gap clearance 54 disposed between the anti-rotation pin 52 and the nozzle assembly 10. A radial gap clearance 55 is also provided and is disposed between the aft flange 38 of the nozzle assembly 10 and the retaining ring 50, thereby providing slight rotational freedom of the nozzle assembly 10, with respect to the retaining ring 50, thereby reducing thermally induced stresses imposed on the nozzle assembly 10 and the retaining ring 50 during operation of the gas turbine system.

To axially retain the anti-rotation pin 52, a seal plate 60 is disposed, and seated along the outer surface 34 of the outer band 14 proximate the outer band trailing edge 26. The seal plate 60 includes a forward side 62, an aft side 64, a radially inner edge 68 and a radially outer edge 70. The seal plate 60 is seated along the radially inner edge 68, with the forward side 62 disposed along the retaining ring 50, thereby forming an interface 72 therebetween. The forward side 62 provides a constraining surface for retaining the anti-rotation pin 52 within the anti-rotation pin slot 40 and the anti-rotation pin hole 53. The retaining ring 50 includes at least one cooling groove 74, but typically the at least one cooling groove 74 comprises a plurality of cooling grooves that are spaced radially from each other and extend circumferentially around the retaining ring 50. The at least one cooling groove 74 is located within the retaining ring 50 and at the interface 72 between the retaining ring 50 and the forward side 62 of the seal plate 60.

Figure 4:
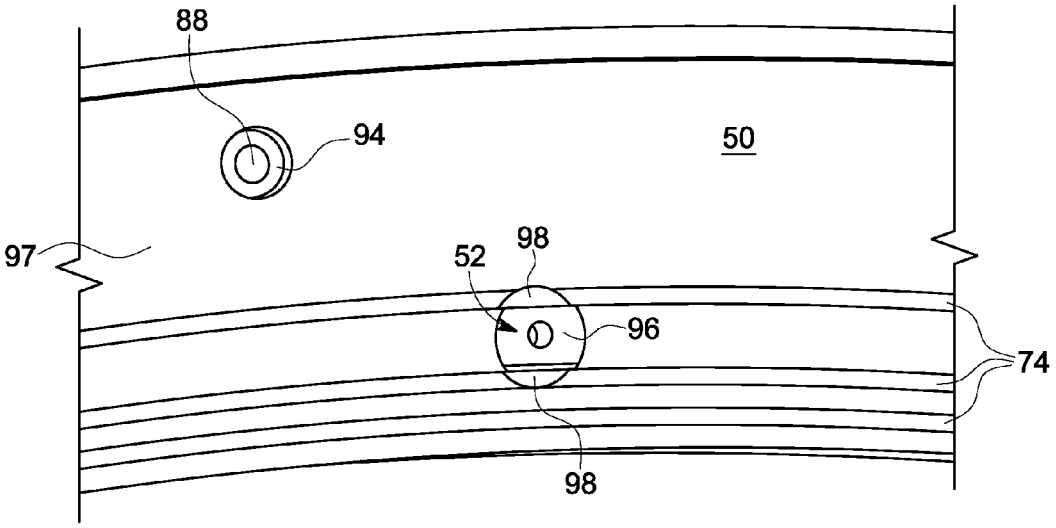
FIG. 4 is a perspective view of a retaining ring and an anti-rotation pin of the nozzle mounting and sealing assembly.

Referring now to FIG. 4, the anti-rotation pin 52 includes an axially rearward end 96 disposed proximate a rearward surface 97 of the retaining ring 50. The axially rearward end 96 has at least one notched portion 98 that corresponds to the at least one cooling groove 74. The at least one notched portion 98 comprises a recess that forms a step, such that the anti-rotation pin 52 does not impede cooling air flowing through the at least one cooling groove 74.

Figure 5:
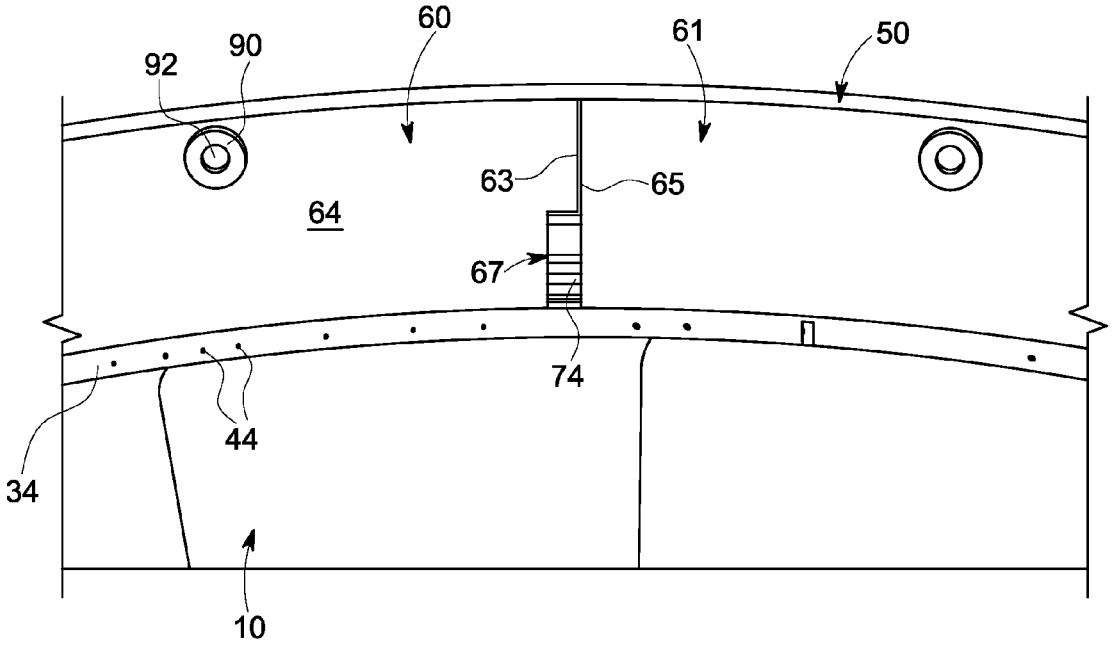
FIG. 5 is a perspective view of a seal plate operably coupled to a retaining ring.

Referring now to FIG. 5, in addition to FIG. 3, the seal plate 60 is secured to the retaining ring 50. The seal plate 60 includes a bored portion 80 comprising a stepped aperture 82, with the bored portion 80 being located proximate the radially outer edge 70 of the seal plate 60. The stepped aperture 82 includes a first portion 84 and a second portion 86, where the perimeter of the first portion 84 is greater than the perimeter of the second portion. The stepped aperture 82 is aligned with a retaining ring counter bore 94 having an aperture 88 disposed within the retaining ring 50. Such an arrangement facilitates installation of a washer 90, which may be of a cup-style washer, through which a mechanical fastener 92, such as a screw or bolt, for example, may be installed, thereby fastening and securing the seal plate 60 to the retaining ring 50. The washer 90 and mechanical fastener 92 arrangement provides structural integrity required to secure the seal plate 60 to the retaining ring 50, while also allowing relative movement between the retaining ring 50 and the seal plate 60, which reduces the likelihood of excessive shear loading of the mechanical fastener 92 during operation of the gas turbine system. Additionally, the configuration of the washer 90, as well as the previously described at least one notched portion 98 of the axially rearward end 96 of the anti-rotation pin 52 provide a relatively flush overall surface for efficient mounting to an adjacent shroud assembly.

An embodiment comprising multiple seal plates is contemplated, with the seal plate 60 being disposed in close proximity to an adjacent seal plate 61. The seal plate 60 includes a first edge 63 residing circumferentially adjacent an edge 65 of the adjacent seal plate 61. The seal plate includes a notched portion 67 along the first edge 63 to improve sealing performance of a seal mating component and to reduce the area of the retaining ring 50 exposed to the hot air-fuel mixture.

Figure 6:
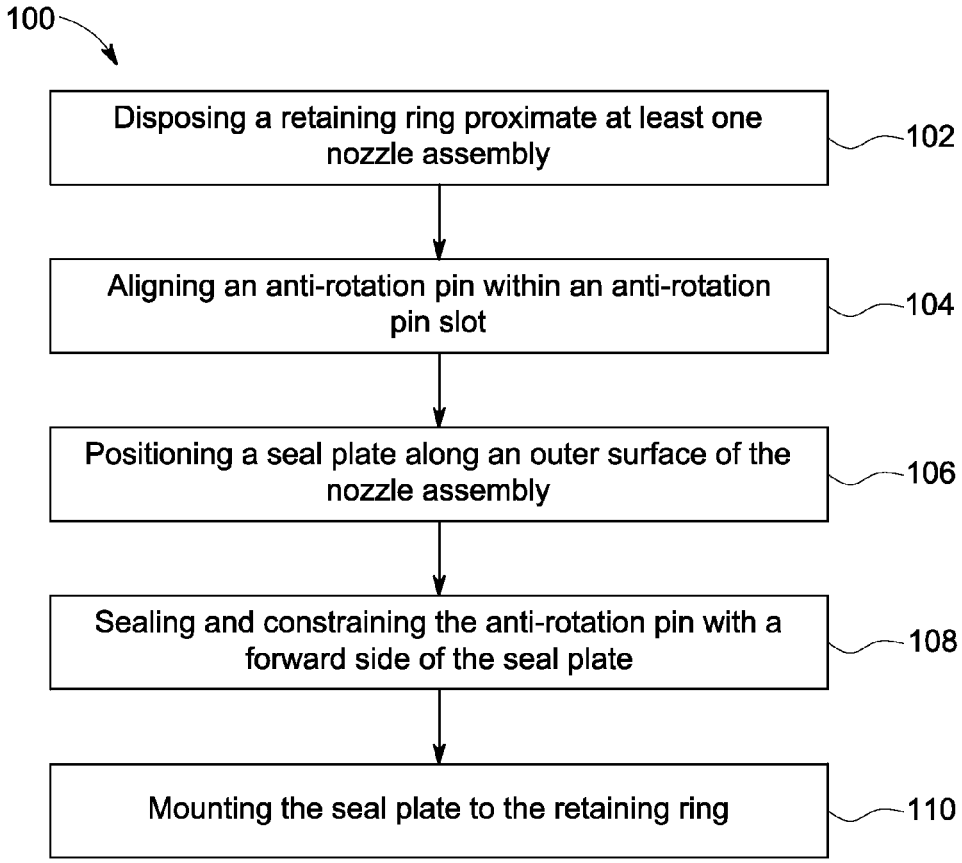
FIG. 6 is a flow diagram illustrating a method of mounting and sealing the nozzle within a gas turbine system.

As illustrated in the flow diagram of FIG. 6, and with reference to FIGS. 1-5, a method of mounting and sealing the nozzle assembly 100 is also provided. The nozzle assembly 10, the seal plate 60 and the retaining ring 50 have been previously described and specific structural components need not be described in further detail. The method of mounting and sealing the nozzle assembly 100 includes disposing the retaining ring proximate at least one nozzle assembly 102. Proper location of the nozzle assembly 10, with respect to the retaining ring 50, includes aligning the anti-rotation pin within the anti-rotation pin slot 104. To retain the anti-rotation pin 52 within the anti-rotation pin slot 40, the seal plate is positioned along the outer surface of the outer band 106. Positioning 106 the seal plate along the outer surface provides a sealing and constraining 108 of the anti-rotation pin with the forward side 62 of the seal plate 60. Mounting the seal plate to the retaining ring 110 includes installing the mechanical fastener 92 into the washer 90, such as the cup-style washer referenced above, where the washer 90 is disposed in the seal plate 60 and into the aperture 88 of the retaining ring 50.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle mounting and sealing assembly for a gas turbine system comprising:

a nozzle having a trailing edge of an outer band and an anti-rotation pin slot;

a retaining ring extending circumferentially about an outer surface of the outer band, wherein the retaining ring includes an anti-rotation pin and an anti-rotation pin hole, wherein the anti-rotation pin is configured to fittingly reside in an axial orientation within the anti-rotation pin slot and the anti-rotation pin hole;

a seal plate seated on the outer surface of the outer band and configured to retain the anti-rotation pin within the anti-rotation pin slot and the anti-rotation pin hole, wherein the seal plate comprises at least one notch disposed proximate a first edge of the seal plate and proximate an edge of an adjacent seal plate; and a washer disposed within a bored portion of the seal plate, wherein the bored portion is aligned with an aperture within the retaining ring, wherein a mechanical fastener extends into the retaining ring through the bored portion to operably couple the seal plate to the retaining ring.

2. The nozzle mounting and sealing assembly of claim 1, wherein the washer is a cup washer disposed within the bored portion of the seal plate.

3. The nozzle mounting and sealing assembly of claim 1, further comprising at least one cooling hole disposed within the outer band proximate the trailing edge of the nozzle.

4. The nozzle mounting and sealing assembly of claim 3, wherein the at least one cooling hole extends angularly at a location radially inward of the seal plate.

5. The nozzle mounting and sealing assembly of claim 1, further comprising an axial gap clearance between the nozzle and the retaining ring proximate an aft flange of the nozzle.

6. A nozzle mounting and sealing assembly for a gas turbine system comprising:

a nozzle having a trailing edge of an outer band and an anti-rotation pin slot;

a retaining ring extending circumferentially about an outer surface of the outer band, wherein the retaining ring includes an anti-rotation pin and an anti-rotation pin hole, wherein the anti-rotation pin is configured to fittingly reside in an axial orientation within the anti-rotation pin slot and the anti-rotation pin hole;

a seal plate seated on the outer surface of the outer band and configured to retain the anti-rotation pin within the anti-rotation pin slot and the anti-rotation pin hole;

a washer disposed within a bored portion of the seal plate, wherein the bored portion is aligned with an aperture within the retaining ring, wherein a mechanical fastener extends into the retaining ring through the bored portion to operably couple the seal plate to the retaining ring; and at least one cooling groove disposed within the retaining ring proximate an interface between the retaining ring and the seal plate, wherein an axially rearward end of the anti-rotation pin includes at least one notched portion corresponding to the at least one cooling groove.

7. The nozzle mounting and sealing assembly of claim 6, wherein the at least one cooling groove comprises a plurality of cooling grooves radially spaced from each other.

8. A nozzle mounting and sealing assembly for a gas turbine system comprising:

a nozzle having an outer band integrally formed with a radially outer portion of at least one vane, wherein the outer band includes a leading edge and a trailing edge;

a retaining ring engaged with and extending circumferentially about an outer surface of the outer band, wherein the retaining ring includes an anti-rotation pin and an anti-rotation pin hole, wherein the anti-rotation pin is configured to fittingly reside within an anti-rotation pin slot and the anti-rotation pin hole;

a seal plate having a forward side, an aft side, a radially inner edge and a radially outer edge, wherein the radially inner edge is disposed along the outer surface of the outer band, thereby retaining the anti-rotation pin within the anti-rotation pin slot, wherein the seal plate comprises at least one notch disposed proximate a first edge of the seal plate and proximate an edge of an adjacent seal plate; and a stepped aperture disposed within the seal plate proximate the radially outer edge, wherein the stepped aperture includes a first bore proximate the aft side and a second bore proximate the forward side, wherein the first bore comprises a larger diameter than the second bore, wherein a cup washer is disposed within the stepped aperture for receiving a mechanical fastener, wherein the mechanical fastener extends into the retaining ring for fastening the seal plate to the retaining ring.

9. The nozzle mounting and sealing assembly of claim 8, further comprising at least one cooling groove disposed within the retaining ring proximate an interface between the retaining ring and the seal plate.

10. The nozzle mounting and sealing assembly of claim 9, wherein the at least one cooling groove extends circumferentially around the outer band of the nozzle.

11. The nozzle mounting and sealing assembly of claim 10, wherein an axially rearward end of the anti-rotation pin includes at least one notched portion corresponding to the at least one cooling groove.

12. The nozzle mounting and sealing assembly of claim 8, further comprising at least one cooling hole disposed within the outer band proximate the trailing edge of the nozzle.

13. The nozzle mounting and sealing assembly of claim 12, wherein the at least one cooling hole extends angularly at a location radially inward of the seal plate seated within the notch of the outer band.

14. The nozzle mounting and sealing assembly of claim 8, further comprising an axial gap clearance between the nozzle and the retaining ring proximate an aft flange of the nozzle.

* * * * *